US006834525B2

(12) United States Patent
Leon et al.

(10) Patent No.: US 6,834,525 B2
(45) Date of Patent: Dec. 28, 2004

(54) ADJUSTABLE CORRUGATION APPARATUS AND METHOD

(75) Inventors: Luis R. Leon, Federal Way, WA (US); Joseph R. Olivadoti, Gig Harbor, WA (US)

(73) Assignee: The Boeing Company, Chicago, IL (US)

( * ) Notice: Subject to any disclaimer, the term of this patent is extended or adjusted under 35 U.S.C. 154(b) by 206 days.

(21) Appl. No.: 10/298,451

(22) Filed: Nov. 18, 2002

(65) Prior Publication Data

US 2004/0093927 A1 May 20, 2004

(51) Int. Cl.[7] ..... B21D 13/02

(52) U.S. Cl. ..... 72/385; 72/379.6; 72/383; 72/416; 72/446

(58) Field of Search ..... 72/164, 165, 181, 72/234, 379.6, 381, 383, 384, 385, 389.1, 414, 416, 446, 447, 449

(56) References Cited

U.S. PATENT DOCUMENTS

| | | | | |
|---|---|---|---|---|
| 3,955,389 A | | 5/1976 | Foster | |
| 3,995,080 A | | 11/1976 | Cogburn et al. | |
| 3,995,081 A | | 11/1976 | Fant et al. | |
| 4,047,354 A | | 9/1977 | Sutherland | |
| 4,047,411 A | | 9/1977 | Foster | |
| 4,084,029 A | | 4/1978 | Johnson et al. | |
| 4,198,018 A | | 4/1980 | Brault | |
| 4,232,540 A | | 11/1980 | Cain et al. | |
| 4,250,728 A | * | 2/1981 | King | 72/177 |
| 4,351,178 A | | 9/1982 | Uehara et al. | |
| 4,409,771 A | | 10/1983 | Lowe | |
| 4,437,726 A | * | 3/1984 | Lambert | 439/825 |
| 4,488,423 A | * | 12/1984 | Newell et al. | 72/385 |
| 4,490,958 A | | 1/1985 | Lowe | |
| 4,597,278 A | | 7/1986 | Hamada et al. | |
| 4,632,862 A | | 12/1986 | Mullen | |
| 4,635,462 A | * | 1/1987 | Bald | 72/385 |
| 4,664,580 A | | 5/1987 | Matoba | |
| 4,967,581 A | | 11/1990 | Ecrepont | |
| 5,848,765 A | | 12/1998 | Gillespie | |
| 5,882,462 A | | 3/1999 | Donecker et al. | |
| 5,937,519 A | * | 8/1999 | Strand | 29/890.03 |
| 6,497,131 B1 | * | 12/2002 | Feijen | 72/297 |
| 6,591,647 B2 | * | 7/2003 | Gerard | 72/17.3 |

FOREIGN PATENT DOCUMENTS

| | | |
|---|---|---|
| DE | 25 03 854 A | 8/1975 |
| DE | 198 02 589 A1 | 7/1999 |
| EP | 1 112 788 A1 | 12/1999 |

OTHER PUBLICATIONS http://www.zeco.at/pg_tbwe_engl1.html; Corrugated Web Beam; Jul. 10, 2002; 1 page.

Siokola, Walter and Hans Poeter; Fabrication Tools For Corrugated Web I–Beams; Modern Steel Construction; July 1999; 3 pages, available at http://www.aisc.org/Content/ContentGroups/Modern_Steel_Construction3/Jul._1999_Issue/9907_04_corrugatedwebi–beams.pdf.

* cited by examiner

*Primary Examiner*—Ed Tolan
(74) *Attorney, Agent, or Firm*—Alston & Bird LLP

(57) ABSTRACT

An apparatus and method for forming corrugated contours in a sheet are provided. The apparatus includes at least three pairs of elongate dies that extend in a longitudinal direction. Each pair of dies is generally parallel and defines a nip therebetween so that the sheet can be moved successively through the nips. At least one actuator is configured to actuate each pair of dies in successively opposed directions generally perpendicular to a direction of motion of the sheet to thereby form the contours in the sheet. Further, each pair of dies is adjustable in a transverse direction generally parallel to the direction of motion of the sheet so that an offset distance between each successive pair of dies can be adjusted.

20 Claims, 7 Drawing Sheets

ADJUSTABLE CORRUGATION APPARATUS AND METHOD

BACKGROUND OF THE INVENTION

1) Field of the Invention

The present invention relates to the forming of sheets and, more particularly, an apparatus and method for forming corrugated contours in a sheet of material such as metal.

2) Description of Related Art

Corrugated sheets are widely used for a variety of applications. For example, metal structural panels used in vehicles, buildings, and containers can be corrugated to provide an increased resistance to bending or buckling relative to flat sheets. Corrugated webs can also be used to form structural components such as beams. A corrugated web beam, for example, includes a corrugated web that extends between top and bottom flanges, and can be used as a beam or column for constructing a larger assembly.

The cross section, or profile, of a corrugated sheet typically defines continuous wave-like sinusoidal contours. The rigidity and other structural characteristics of the sheet are determined, in part, by the shape of the sinusoidal contours, including the "wavelength" and "amplitude" of each contour. Thus, it is often desirable to produce corrugated sheets having different profiles for different applications. According to one conventional method of forming corrugated sheets, a flat sheet of material such as steel is stamped between a pair of cooperable dies that define the corrugated contours. A corrugated sheet that is longer than the dies, i.e., defines a greater number of corrugations than provided by the dies, can be formed by repeatedly advancing the sheet so that a flat or unformed portion of the sheet is disposed between the dies and stamping the sheet therein. However, in order to form sheets with different profiles, the dies must be changed. Therefore, different dies are required, and an operator must stop the formation process and change the dies to change the profile, increasing the cost and time required for forming the corrugated sheets.

Thus, a need exists for an apparatus and method for forming corrugated sheets such as sinusoidal sheets formed of metal. The apparatus should be adaptable to provide sheets with different profiles, while operating with minimal interruptions to increase output and minimize cost. Preferably, a minimum number of profile-specific dies or other components should be required.

BRIEF SUMMARY OF THE INVENTION

According to one embodiment, the present invention provides an apparatus for forming a corrugated contour in a sheet. The apparatus includes at least three pairs of elongate dies, such as cylindrical rolls, that extend in a longitudinal direction. The dies of each pair are generally parallel and define a nip therebetween so that the sheet can be moved successively through the nips for forming. Each pair of dies can be actuated in successively opposed directions generally perpendicular to a direction of motion of the sheet to thereby form corrugated contours in the sheet. The dies can be extended by differing distances to form contours of different heights in the sheet. Further, each pair of dies is adjustable in a transverse direction generally parallel to the direction of motion of the sheet so that an offset distance between each successive pair of dies can be adjusted. For example, each die can be connected to a track that extends generally in a direction parallel to the motion of the sheet. The longitudinally opposed ends of each die can be adjustable by differing distances in the transverse direction so that the dies can be configured at relative angles, and a controller, such as a programmable logic controller, can be provided for adjusting the dies according to a desired configuration of the sheet. The apparatus can also include a heater for heating the sheet to a forming temperature.

The present invention also provides a method for forming a corrugated contour, such as a sinusoidal contour, in a sheet. The sheet can be formed of a variety of materials such as aluminum or titanium and can be heated before forming. The method includes providing at least three pairs of the elongate dies, adjusting the dies in the transverse direction to adjust the offset distance between each successive pair of dies, advancing a sheet of material between the dies of each pair so that an unformed portion of the sheet is disposed therebetween. The dies are actuated in successively opposed directions generally perpendicular to the direction of motion of the sheet to thereby bend the sheet and form at least one corrugated contour.

The sheet can be repeatedly advanced and the dies actuated to selectively form multiple corrugated contours in the sheet, and the dies can be adjusted between each successive actuation so that a length of the corrugated contours differs throughout the sheet. Further, the ends of each die can be adjusted transversely by different distances to configure the dies at relative angles and form the contours at an angle oblique to the direction of motion of the sheet. The dies can also be extended by differing distances so that the height of the contours differs throughout the sheet. According to one embodiment, a list of control instructions are stored in a memory device and retrieved for use by a controller that controls the apparatus.

BRIEF DESCRIPTION OF THE SEVERAL VIEWS OF THE DRAWINGS

Figure 1:
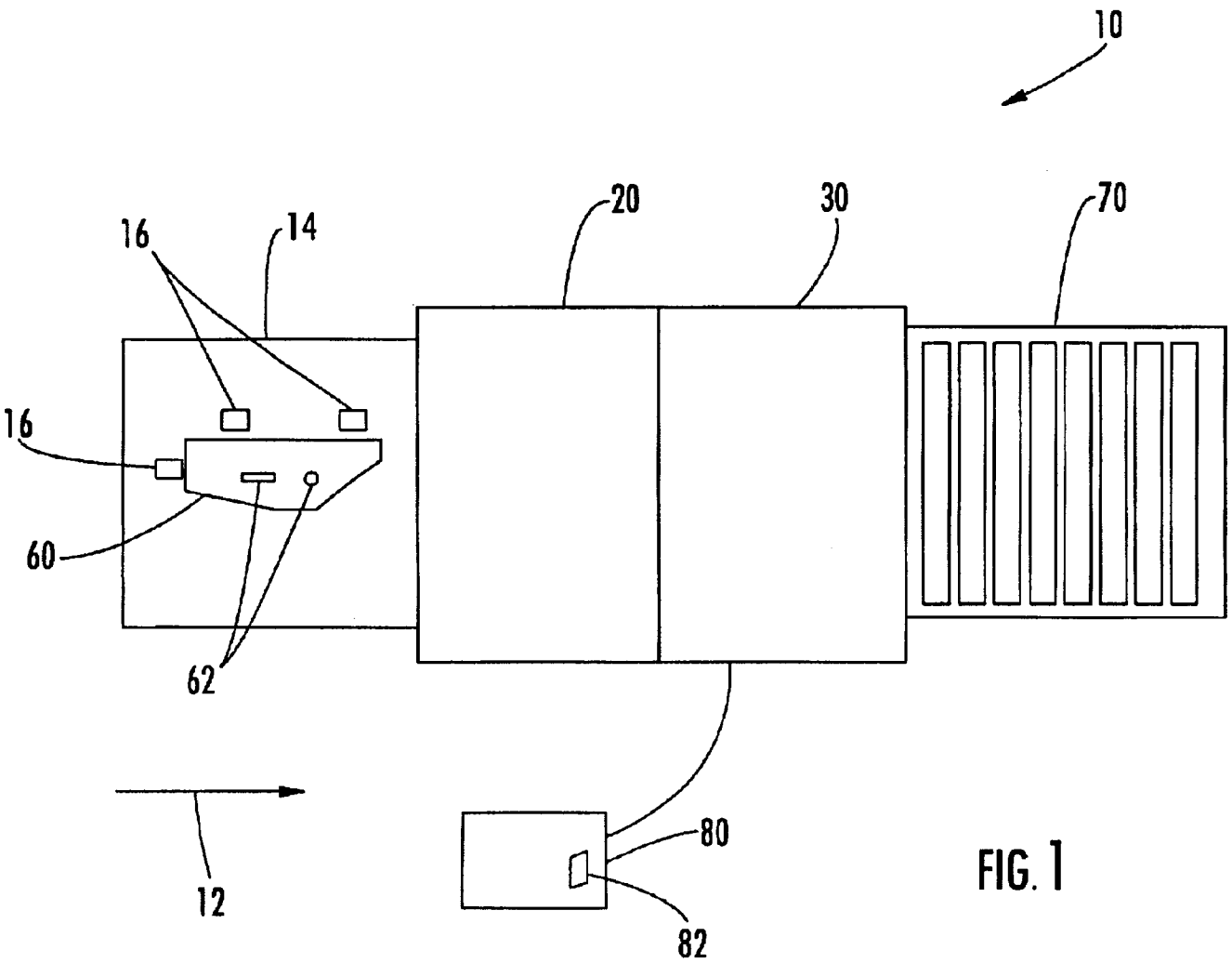
Figure 2:
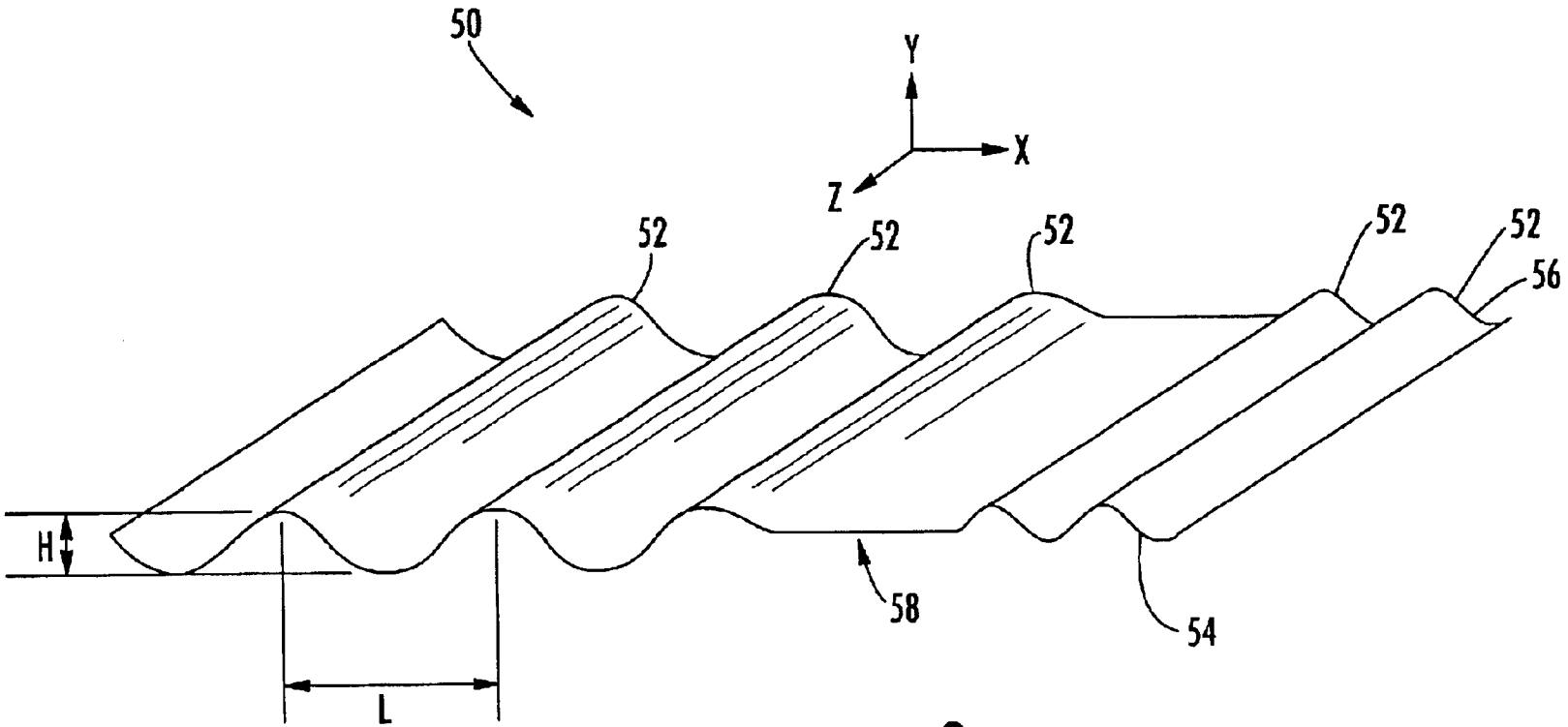
Figure 3A:
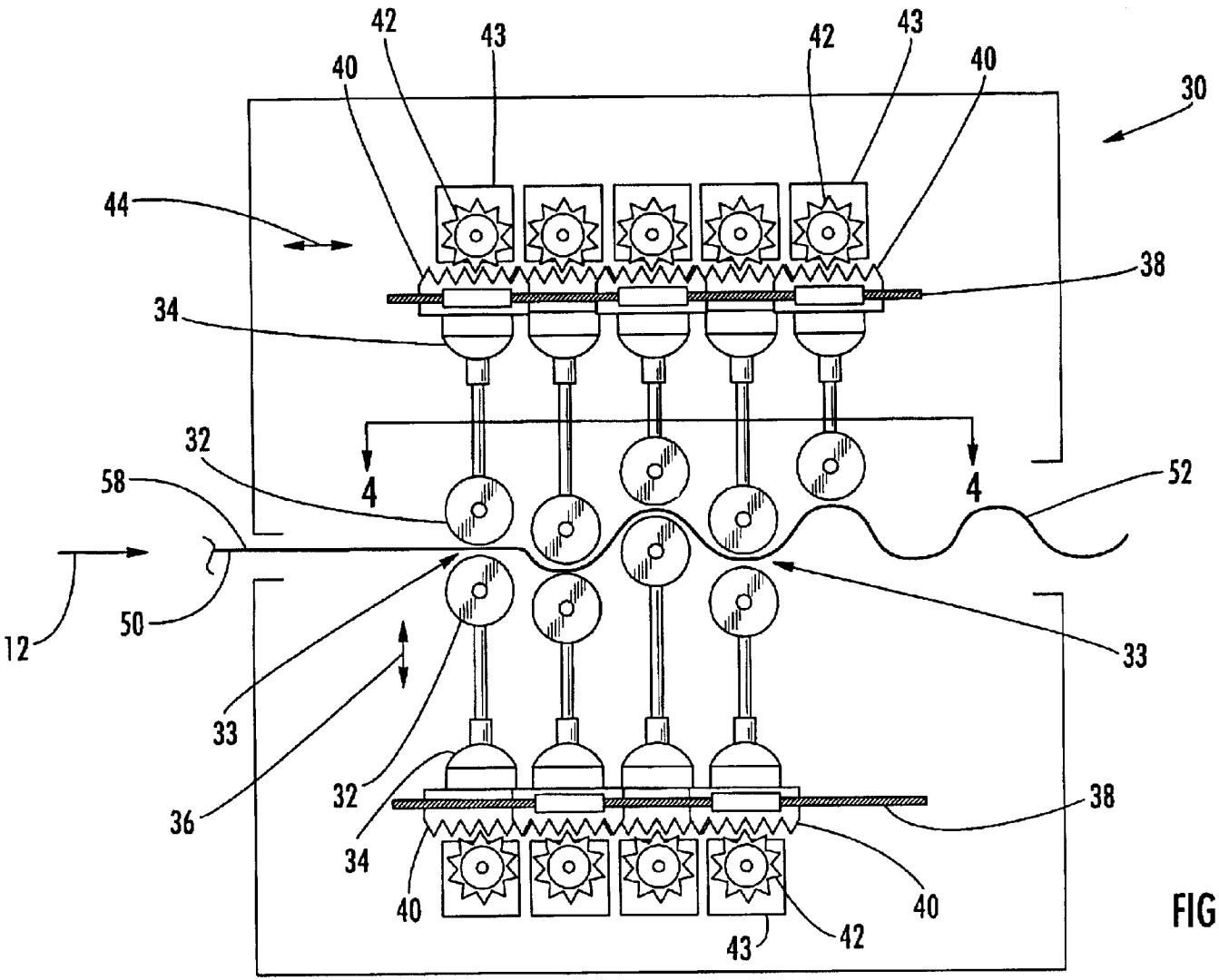
Figure 3B:
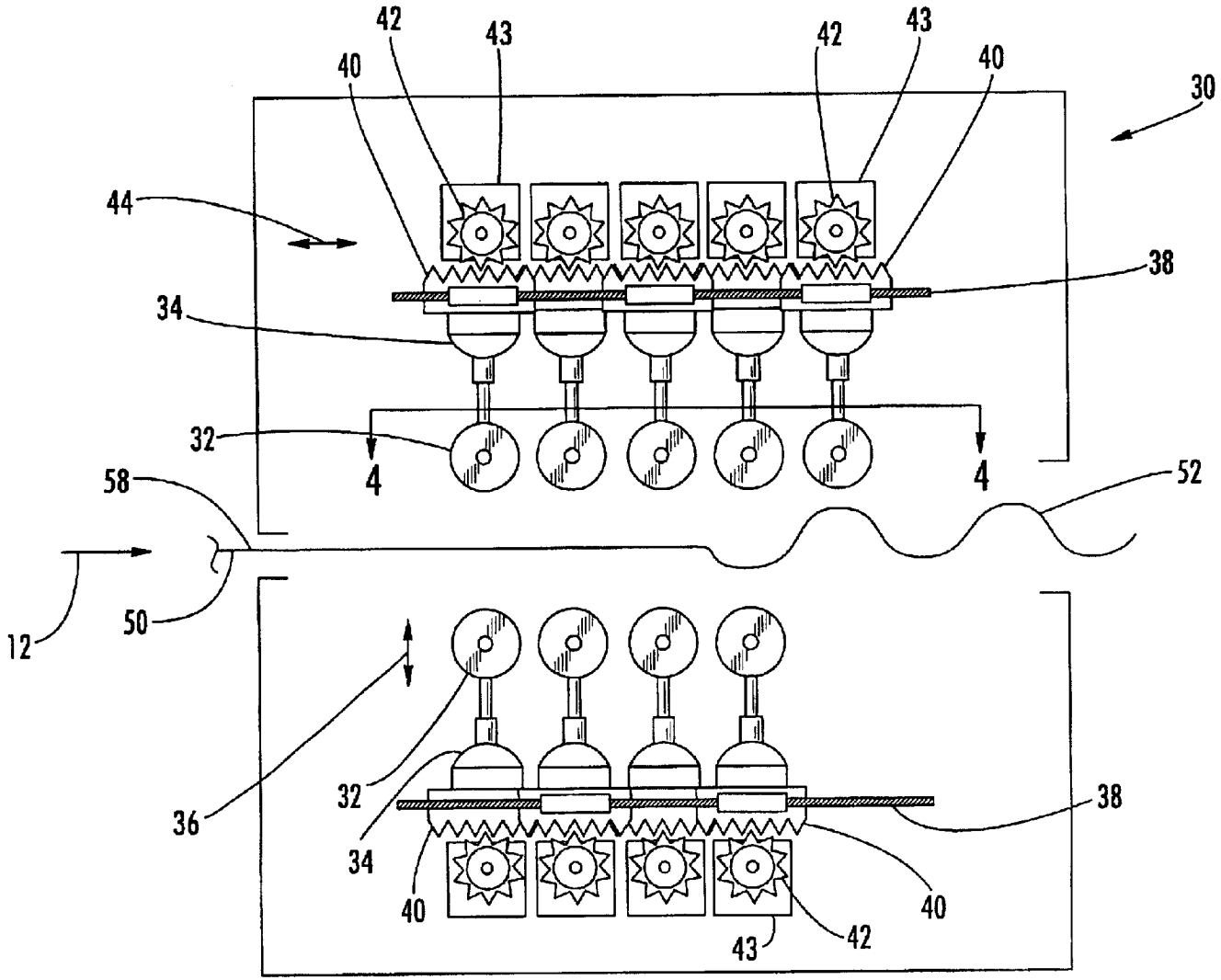
Figure 4:
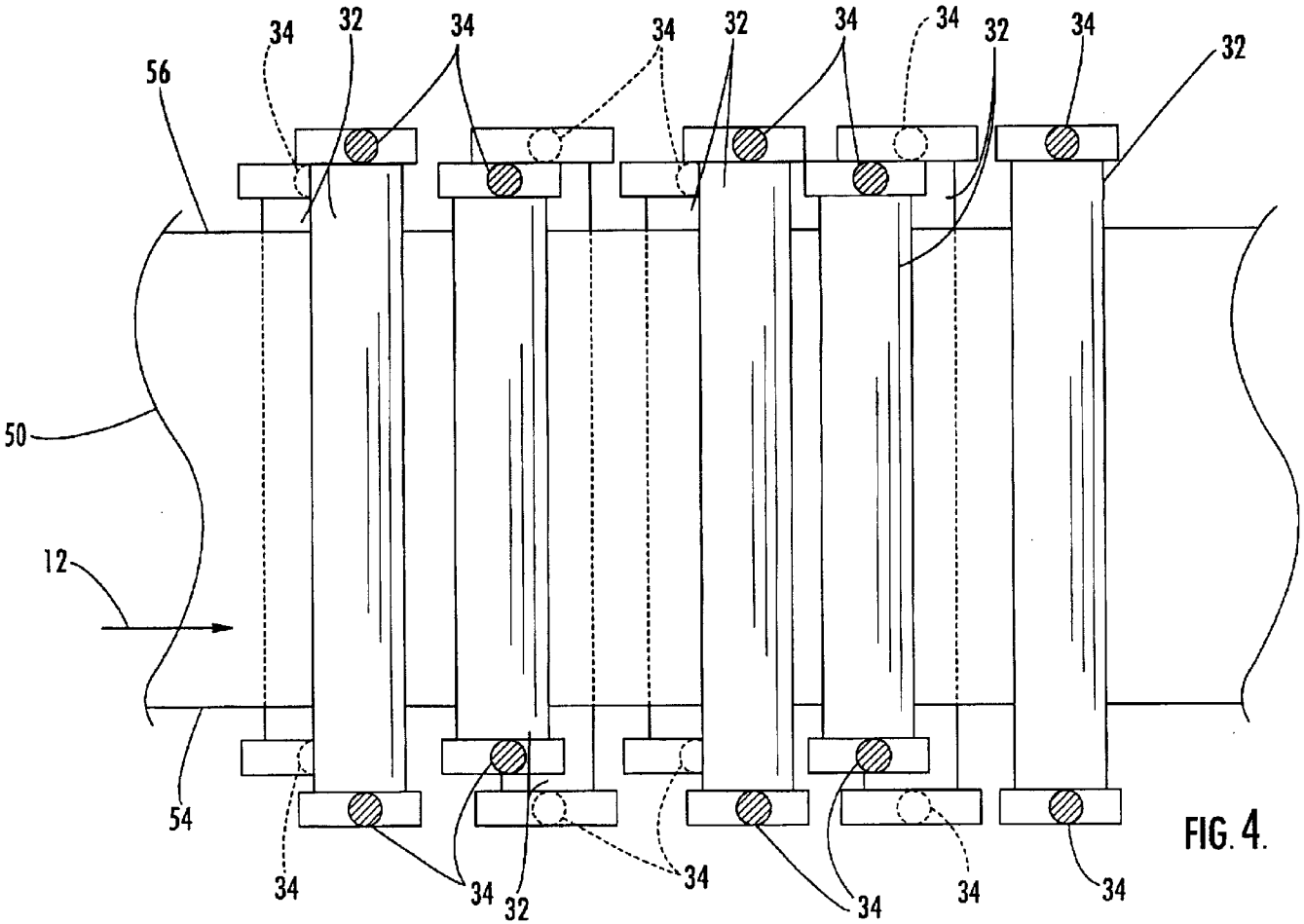
Figure 5:
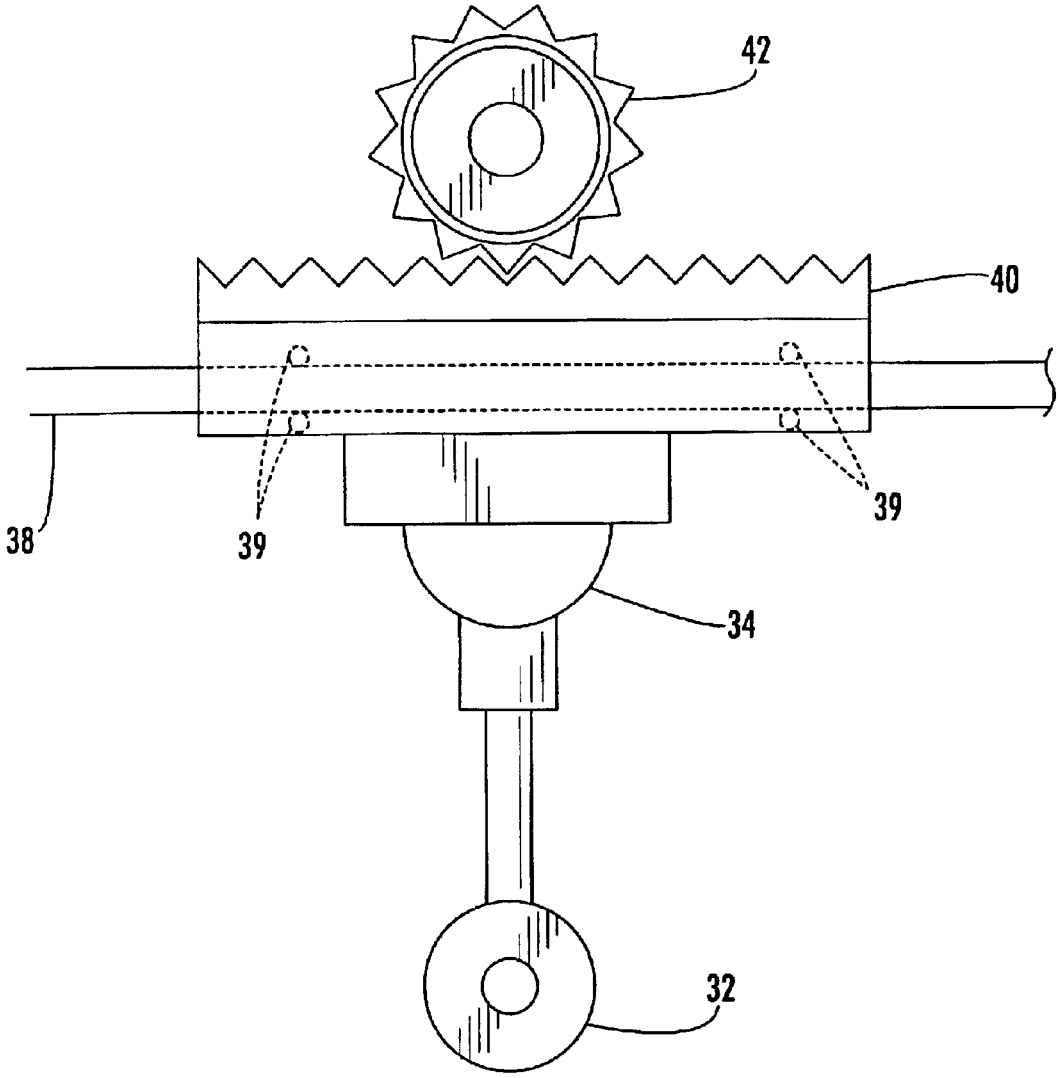
Figure 6B:
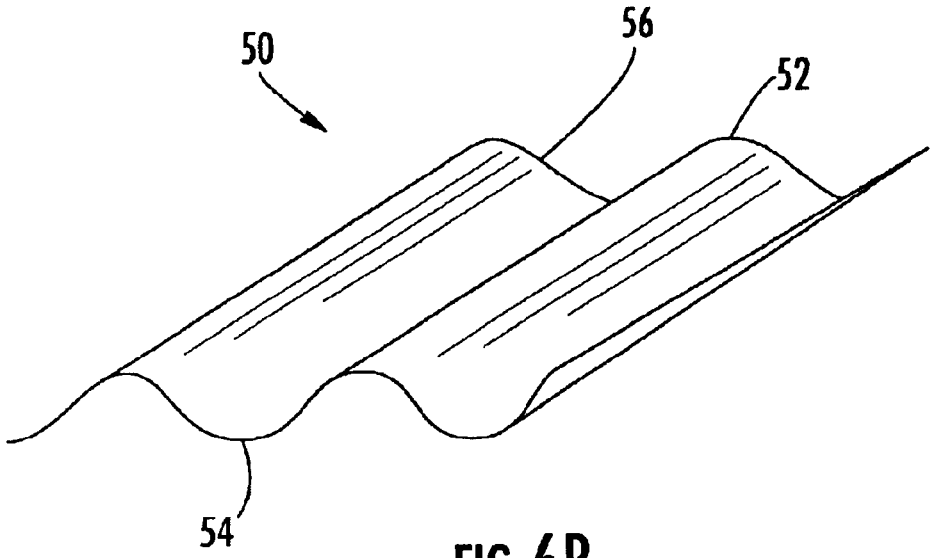
Figure 6A:
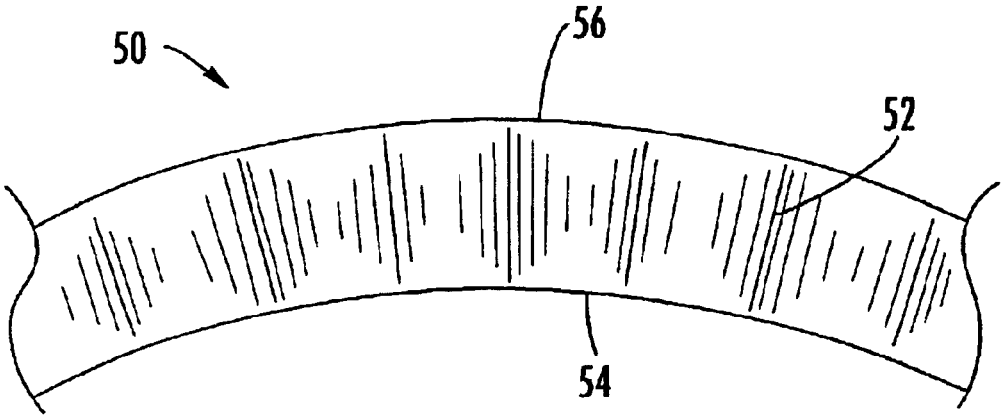

Having thus described the invention in general terms, reference will now be made to the accompanying drawings, which are not necessarily drawn to scale, and wherein:

FIG. 1 is a plan view of an apparatus for forming a corrugated contour in a sheet according to one embodiment of the present invention;

FIG. 2 is a perspective view of a corrugated sheet of material formed by the apparatus of FIG. 1;

FIG. 3A is an elevation view of the forming portion of the apparatus of FIG. 1;

FIG. 3B is an elevation view of the forming portion of the apparatus of FIG. 1 shown in an open configuration;

FIG. 4 is a section view of the forming portion of the apparatus of FIG. 1 as seen along line 4—4 of FIGS. 3A and 3B;

FIG. 5 is a partial elevation view of the forming portion of the apparatus of FIG. 1;

FIG. 6A is a plan view of a corrugated sheet of material that is formed in a curved configuration by the apparatus of FIG. 1; and FIG. 6B is a perspective view of the sheet of FIG. 6A.

DETAILED DESCRIPTION OF THE INVENTION

The present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Referring now to FIG. 1, there is illustrated an apparatus 10 for forming corrugated contours in a sheet according to one embodiment of the present invention. A corrugated sheet 50 formed in the apparatus 10 is shown in FIG. 2. The sheet 50 can be formed of a variety of materials including metals such as aluminum, titanium, steel, composite materials, polymers, and the like. The sheet 50 defines at least one corrugated contour 52 defining a length L and height H and extending from a first end 54 of the sheet to a second end 56. As further discussed below, the contours 52 can define a variety of shapes, such as a sinusoidal contour that is uniform across a width of the sheet 50, i.e., in the direction of the Z-axis as shown in FIG. 2.

The sheet 50 is formed from a blank 60, or preformed sheet, which can be pre-configured in a desired shape or to define features such as apertures 62, as shown in FIG. 1. The blank 60 can be a piece of material of a predetermined length that is formed into a single sheet 50, or the blank 60 can comprise a piece of material that is longer than the desired sheets 50, such as a roll of sheet metal, that is formed and cut into the individual sheets 50. The blank 60 is advanced into the apparatus 10 in a direction 12 from a guide table 14. The blank 60 can be heated in a heater 20 and formed in a forming portion 30 of the apparatus 10. The formed sheet 50 is then output onto a roller take-up table 70. The apparatus 10 can be controlled from a control panel 80 by an operator or a controller 82. For example, the controller 82 can be a programmable logic controller, or "PLC," as known to those skilled in the art. A PLC typically also includes a memory device in which operation parameters can be stored. The operation parameters, which can be used to control the actions and timing of the apparatus 10, can be programmed by the operator. Alternatively, the operation parameters can be "learned," for example, during a learning mode of operation in which the operator controls actions of the apparatus 10. Thus, the apparatus 10 can easily be made to repeat a particular list of operation parameters and thereby process one or more blanks 60 and sheets 50.

As shown in FIGS. 3A, 3B, and 4, the forming portion 30 of the apparatus 10 includes a plurality of elongate dies 32 configured in opposed pairs. The dies 32 can define a variety of shapes to correspond to a desired shape of the corrugated contours 52 of the sheet 50. For example, the dies 32 can be cylindrical rollers as shown in FIGS. 3A, 3B, and 4. In other embodiments, the dies 32 can have other cross-sectional shapes such as triangular or rectangular. Each die 32 extends in a longitudinal direction (into the page in FIGS. 3A and 3B), and the dies 32 of each pair are parallel to define nips 33 therebetween. FIGS. 3A, 3B, and 4, for example, illustrate a forming portion 30 that includes nine dies 32, eight of which are arranged to form four pairs with four nips 33. Other number of dies 32 and nips 33 can be used, but the apparatus 10 preferably includes at least three pairs of dies 32. Actuators 34 are configured to extendably adjust the dies 32 such that each die 32 can be extended toward or retracted from the sheet 50. The actuators 34 can be hydraulic, pneumatic, or electric devices or other actuation devices as are known in the art. As shown in FIG. 4, each die 32 can be connected to two actuators 34, one actuator being connected at each end of the die 32. In other embodiments, a greater or lesser number of actuators 34 can be configured to extend each die 32. For example, a single actuator 34 can be configured to extend each die 32, or a single actuator 34 can be configured to extend more than one die 32.

Each pair of dies 32 and the nip 33 formed thereby can be extended by the actuators 34 in either of opposed directions 36. By extending the dies 32 toward the sheet 50 and to different positions, the dies 32 can be used to engage the sheet 50 in the nips 33 and bend the sheet 50. Each successive pair of dies 32 can be extended in alternately opposed directions 36 between an open configuration, shown in FIG. 3B, and a closed configuration, shown in FIG. 3A, to form the corrugated contours 52 in the sheet 50. The extension of each pair of dies 32 can also be adjusted, thereby affecting the height H of the contours 52 in the sheet 50.

The dies 32 are also adjustable in a transverse direction generally parallel with the direction of motion of the sheet 50. For example, as shown in FIGS. 3A and 3B, each of the actuators 34 is mounted on a track 38 that extends generally parallel to a direction of motion of the sheet 50. The track 38 maintains each actuator 34 and, hence, the respective die 32 in alignment with the sheet 50 so that the direction of extension of each die 32 is generally perpendicular to the sheet 50. For example, as shown in FIG. 5, each actuator 34 can be connected to rollers 39 that engage the track 38. Each actuator 34 is further connected to a rack gear 40 that engages a pinion adjustment gear 42. Actuators 43, such as electric or hydraulic motors, are provided for rotatably actuating the pinion gears 42. Each actuator 43 is connected to a power source (not shown) such as a power supply for providing electrical energy or a pump and/or pressure vessel for supplying pressurized hydraulic fluid. The type of actuator 43 and the associated power source can be selected according to the operating temperature of the apparatus 10, the force required from the actuators 43 for forming the sheets 50, desired reaction speeds of the actuators 43, and the like.

As each pinion gear 42 is rotated, the respective rack gear 40 is translated in one of opposed directions 44 generally parallel to the direction of motion of the sheet 50. Thus, an offset distance between each successive pair of dies 32 can be adjusted by rotating the pinion gears 42 and thereby translating the respective dies 32 in the directions 44. If the offset distance between each pair of dies 32 is increased, the length L of each resulting corrugated contour 52 in the sheet 50 is increased. Alternatively, if the offset distance is decreased, the length L of the contours 52 is decreased. Thus, by adjusting the pinion gears 42 and the extension of the actuators 34, the length L and height H of the corrugated contours 52 can be adjusted according to the desired configuration of the sheet 50. It is appreciated that the dies 32 can be mounted and adjusted transversely in manners other than that described above. For example, each die 32 can be slidably mounted on a transverse rail and adjusted by a linear actuator or a belt or chain drive. The mounting and type of actuator can be selected according to expected operating temperatures, mechanical loads, and the like. Additionally, the actuators 34, 43 can be mounted in a staggered configuration, as shown in FIG. 4, to allow greater adjustment of each die 32 in the directions 44.

Preferably, each longitudinal end of the dies 32 can be translated independently, for example, by adjusting separate pinion gears 42 that engage rack gears 40 connected to each of the longitudinally opposed ends of the die 32. Thus, the ends of each die 32 can be translated to different positions, so that the offset distances of the successive dies 32 are different at the longitudinal ends of the dies 32, and the dies 32 are configured at relative angles such as an angle oblique to the direction 12 of motion of the sheet 50. For example, the offset distance between the successive dies 32 can be made smaller at the first end of the apparatus 10 than at the second end of the apparatus 10 so that the length L of the contours 52 is shorter at the first end 54 of the sheet 50 than the second end 56, resulting in corrugations having a somewhat funneled configuration.

During operation, the blank 60 enters the apparatus 10 from the guide table 14. If the blank 60 is a long piece of material, the blank 60 may be provided from a roll of the material to the guide table 14. The guide table 14 can include one or more guides 16 such as rails, edges, rollers, or other aligning devices that guide the blank 60 into the apparatus 10 in a desired orientation. The guide table 14 can also include one or more detection devices (not shown), such as optical sensors or cameras, for detecting the position, size, features, and the like of the blank 60 to determine if the blank 60 is defective or improperly aligned. From the guide table 14, the blank 60 is advanced through the heater 20, where the blank 60 can be heated to a forming temperature. The heater 20 can comprise any type of heating device, including an electrical resistance heater, an induction heater, or a gas furnace. The amount of heat provided by the heater 20 can be adjustable according to the type, size, and material properties of the blank 60, the rate at which the blank 60 is advanced through the heater 20, the type of forming that is to be performed, and the like. Further, although the heater 20 is shown as a separate device from the guide table 14 and the forming portion 30 of the apparatus 10, the heater 20 can be part of those or other portions of the apparatus 10. For example, the heater 20 can be disposed in the forming portion 30 so that the blank 60 or sheet 50 is heated before, during, or after forming. According to one embodiment of the invention, the heater 20 heats the blank 60 and/or sheet 50 to a forming temperature between about 200° F. and 1400° F. For example, a blank formed of titanium can be heated to about 1350° F. by the heater 20. It is appreciated that the blanks 60 or sheets 50 can be heated according to the material from which the blank 60 or sheet 50 is formed. Thus, the heater 20 can be selected and configured according to the blanks 60 or sheets 50 that are to be formed.

The actuators 34 in the forming portion 30 of the apparatus 10 retract the dies 32 to adjust the dies 32 to an open position, shown in FIG. 3B, and the blank 60 is advanced into the apparatus 10 so that an unformed portion 58 of the blank 60 or sheet 50 is disposed between the dies 32. Before or after the sheet 50 enters the apparatus 10, the dies 32 are adjusted transversely by adjusting the pinion gears 42 and translating the rack gears 40 and, hence, the actuators 34, in the directions 44. The rack gears 40 and actuators 34 are adjusted transversely so that the dies 32 are configured to form the corrugated contours 52 at the desired locations in the blank 60 and so that the contours 52 are formed with the desired lengths L. The actuators 34 then extend the dies 32 to a closed position such that the dies 32 engage the sheet 50 and form the sheet 50, for example, by actuating successive pairs of the dies 32 in opposite directions to form corrugated contours 52 as shown in FIG. 3A. Alternatively, successive pairs of the dies 32 can be extended or kept stationary so that the dies 32 in the closed position define a similar corrugated shape. The dies 32 are then retracted to the open position, and the sheet 50 is advanced in the apparatus 10. If additional corrugated contours 52 are desired, the apparatus 10 can perform repeated cycles by advancing the sheet 50 so that another unformed portion 58 of the sheet 50 is disposed between the dies 32 and actuating the dies 32 to form the desired number of contours 52 in the sheet 50.

As shown in FIGS. 6A and 6B, the height H and length L of the corrugated contours 52 can vary throughout one sheet 50 by extending the dies 32 by different distances, i.e., to different positions, while forming the different portions of the sheet 50 and by adjusting the transverse position of the dies 32 between the formation of the different portions of the sheet 50. For example, each of the dies 32 can be extended by a different distance during a single forming cycle, and each die 32 can be extended by a different distance during successive forming cycles. The length L of the contours 52 can be changed by adjusting the actuators 34 and dies 32 transversely with the pinion gears 42. A flat or otherwise unformed portion 58 of the sheet 50 can be left unformed by advancing the portion 58 through the dies 32. Further, as shown in FIGS. 6A and 6B, the height H and length L of each contour 52 can be nonuniform, i.e., the height H and/or length L of one contour 52 can be greater or lesser at the first end 54 of the sheet 50 than at the second end 56 of the sheet 50. As shown in FIGS. 6A and 6B, the height H can be greater at the first end 54, and the length L can be greater at the second end 56 so that the sheet 50 is made to curve toward the first end 54. The magnitude of the curvature is shown exaggerated from the likely curvature of the sheet 50 for purposes of illustration in FIGS. 6A and 6B. Such a curved sheet 50 can be used to form a web for an arched corrugated web beam or for other structural applications.

The control panel 80 can be manually adjusted by an operator, or the process can be automatically controlled by the controller 82 according to a list of forming instructions or according to a desired contour of the sheet 50. For example, the controller 82 can be programmed with a set of instructions, can learn according to positions of the dies 32 that are manually set by an operator, and/or can calculate forming instructions for controlling the dies 32 according to instructions that include such characteristics as the size of the blank 60, the desired number of contours 52, the height H and length L of the contours 52, the desired dimensions of the formed sheet 50, the desired or preformed features in the sheet 50, and the like. The controller 82 also preferably includes a memory device for storing the instructions. Thus, the operator can easily use the apparatus 10 to form multiple similar sheets 50 as desired with minimal configuration of the apparatus 10 being required.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An apparatus for forming a corrugated contour in a sheet, the apparatus comprising:

at least three pairs of elongate dies extending in a longitudinal direction, the dies of each pair being generally parallel and defining a nip therebetween; and at least one actuator configured to actuate each pair of dies generally perpendicular to a direction of motion of the sheet between open and closed positions to thereby form corrugated contours in the sheet, said dies of each pair being configured in said open position such that the sheet is translatable in the direction of motion therebetween, wherein each pair of dies is adjustable in a transverse direction generally parallel to the direction of motion of the sheet such that an offset distance between each successive pair of dies is adjustable.

2. An apparatus according to claim 1 wherein each die is connected to a track extending generally in a direction parallel to the motion of the sheet.

3. An apparatus according to claim 1 wherein first and second longitudinally opposed ends of each die are adjustable by differing distances in the transverse direction such that the dies are capable of being configured at relative angles.

4. An apparatus according to claim 1 wherein each of the dies is a cylindrical roll.

5. An apparatus according to claim 1 further comprising a controller configured to adjust the dies in the transverse direction according to a desired configuration of the sheet.

6. An apparatus according to claim 1 further comprising a heater configured to heat the sheet to a forming temperature before the sheet is formed in the apparatus.

7. An apparatus according to claim 1 wherein the dies are adapted to be extended by said actuators in successively opposed directions to form the corrugated contours.

8. An apparatus according to claim 1 wherein the dies are adapted to be extended by differing distances such that a height of the corrugated contours differs throughout the sheet.

9. An apparatus according to claim 1 wherein longitudinally opposed ends of each die are configured to be extended by differing distances such that a height of the corrugated contour is non-uniform across a width of the sheet.

10. A method for forming a corrugated contour in a sheet, the method comprising:

providing at least three pairs of elongate dies extending in a longitudinal direction, the dies of each pair being generally parallel;

adjusting the dies in a transverse direction such that an offset distance between each successive pair of dies is adjusted;

advancing a sheet of material between the dies of each pair such that an unformed portion of the sheet is disposed therebetween; and actuating the dies generally perpendicular to the direction of motion of the sheet to thereby bend the sheet and form at least one corrugated contour.

11. A method according to claim 10 wherein said actuating step comprises actuating the pairs of dies in successively opposed directions to form the corrugated contours in the sheet.

12. A method according to claim 10 further comprising repeating said adjusting step between successive actuating steps such that a length of the corrugated contours differs throughout the sheet.

13. A method according to claim 10 wherein said adjusting step comprises adjusting first and second longitudinally opposed ends of each die by different distances in the transverse direction such that the dies are configured at relative angles and the corrugated contours formed in the sheet are disposed at an oblique angle relative to the direction of motion of the sheet.

14. A method according to claim 10 wherein said actuating step comprises extending the dies by differing distances such that a height of the corrugated contours differs throughout the sheet.

15. A method according to claim 10 wherein said actuating step comprises extending longitudinally opposed ends of at least one of the dies by differing distances such that a height of the corrugated contour differs across a width of the sheet.

16. A method according to claim 10 wherein said actuating step comprises forming at least one sinusoidal contour in the sheet.

17. A method according to claim 10 further comprising heating the sheet before said actuating step.

18. A method according to claim 10 wherein said advancing step comprises providing a sheet comprised of at least one of the group consisting of aluminum and titanium.

19. A method according to claim 10 further comprising storing a list of control instructions in a memory device and retrieving the control instructions for use by a controller in controlling said adjusting, advancing, and actuating steps.

20. A method according to claim 10 further comprising repeating said advancing and actuating steps to selectively form corrugated contours in the sheet.

* * * * *